United States Patent [19]

Caple

[11] Patent Number: 4,855,640

[45] Date of Patent: Aug. 8, 1989

[54] CATHODE RAY TUBE WITH METAL REAR HOUSING AND FACEPLATE SUPPORT

[75] Inventor: Adrian Caple, Purley, England

[73] Assignee: U.S. Philips Corporation, New York, N.Y.

[21] Appl. No.: 236,276

[22] Filed: Aug. 22, 1988

Related U.S. Application Data

[63] Continuation of Ser. No. 87,720, Aug. 20, 1987, abandoned.

[30] Foreign Application Priority Data

Aug. 22, 1986 [GB] United Kingdom ..... 8620471

[51] Int. Cl.[4] ..... H01J 29/86

[52] U.S. Cl. ..... 313/477 R; 313/422; 313/495; 220/2.3 A

[58] Field of Search ..... 313/477 R, 495, 422; 220/2.3 A

[56] References Cited

U.S. PATENT DOCUMENTS

| | | | |
|---|---|---|---|
| 2,635,205 | 4/1953 | Olson | 220/2.3 A |
| 2,969,163 | 1/1961 | Roberts | 220/2.3 A |
| 3,171,771 | 3/1965 | Badger et al. | 220/2.3 A |
| 3,219,225 | 11/1965 | Hempel | 220/2.3 A |
| 4,268,712 | 5/1981 | Overall | 313/477 R |
| 4,325,489 | 4/1982 | Russell et al. | 313/422 X |
| 4,522,309 | 6/1985 | Overall et al. | 220/2.1 A |

FOREIGN PATENT DOCUMENTS

| | | | |
|---|---|---|---|
| 121244 | 6/1986 | Japan . | |
| 1377364 | 12/1974 | United Kingdom | 313/477 R |
| 2187036 | 8/1978 | United Kingdom . | |

*Primary Examiner*—Palmer C. DeMeo
*Attorney, Agent, or Firm*—John C. Fox

[57] ABSTRACT

A cathode ray tube has an envelope comprising a flat glass faceplate covering an opening defined by a side wall of a metal rear housing and sealingly mounted on a flange provided on the side wall. To increase its flexiblity and enable the flange surface adequately to conform with the faceplate edge and accommodate deflections thereof upon, for example, evacuation of the envelope, particularly when a glass frit seal is used, the flange is formed so that it extends from the side wall in one direction, either inwardly or outwardly of the opening, and turns back on itself to provide an outer surface onto which the faceplate edge is bonded. By spacing the portions of the flange extending in opposite directions slightly apart, minor variations in the flatness of the faceplate and/or flange surface can also be accommodated.

10 Claims, 2 Drawing Sheets

CATHODE RAY TUBE WITH METAL REAR HOUSING AND FACEPLATE SUPPORT

This is a continuation of application Ser. No. 087,720 filed Aug. 20, 1987, now abandoned.

BACKGROUND OF THE INVENTION

This invention relates to a cathode ray tube having an envelope comprising a metal rear housing having a wall portion defining an opening and a substantially flat glass faceplate which extends over the opening and is sealed in a vacuum-tight manner to the surface of a flange on the rear housing extending around the opening.

The rear housing, which in the finished cathode-ray tube contains means for producing an electron beam, for example an electron gun, and other components of the tube, is usually referred to as the cone portion of the envelope, although it may not be strictly, or even remotely, conical in the geometric sense. For example, a new type of rear housing which is very relevant to the present invention and which may be referred to as a "flat-can" rear housing has the form of a shallow, rectangular, metal can with a generally flat, slightly dished or ribbed, bottom and an open top surrounded by a flange. An envelope having this type of rear housing is used in so-called flat cathode-ray tubes. To form the envelope a rectangular flat glass faceplate is sealed to the flange of the can.

A cathode ray tube of the type mentioned in the opening paragraph is described in British Patent Application No. 8604321. In order to reduce costs, especially in the case of comparatively large tubes, the metal rear housing of the described tube consists of mild steel for cheapness and ease of forming and the faceplate consists of flat toughened float glass which is significantly cheaper than conventional moulded glass faceplates and which need not be so thick so that it is lighter. Such materials are not ideally matched as regards their coefficients of thermal expansion but by using a compliant pressure bonded seal to bond the faceplate and metal rear housing together and provide a seal therebetween, the effects of the difference in the coefficients of thermal expansion can be accommodated.

The faceplate mounting flange of the tube described in the aforementioned patent application projects inwardly of the opening. The provision of an inwardly-projecting flange together with a compliant pressure bonded seal enables small deflections of the faceplate upon evacuation of the envelope volume to be accommodated generally satisfactorily without the risk of the faceplate peeling away from the flange, and thus avoids the problem encountered with an outwardly-projected flange arrangement such as is described in British patent specification No. 2,133,210 where clamping elements are positioned around the periphery of the faceplate to hold the faceplate firmly against the flange and prevent such peeling.

However, it can become more economical and advantageous particularly with comparatively small sized cathode ray tubes to use plate glass for the faceplate and a thermally-matched metal alloy for the rear housing with a glass frit sealing material bonding the faceplate to the flange of the rear housing.

Glass frit seals are stiffer than pressure bonded seals but, because the faceplate is thermally matched to the metal of the rear housing, provide a convenient form of sealing as it is not required to allow for differences in the coefficients of thermal expansion of the materials of the rear housing and faceplate. Moreover, the dimensions of the seal area need not be so great as those necessary for a compliant pressure bonded seal so that a narrower flange can be used with a consequent reduction in the proportion of the faceplate area used for bonding. Also, higher baking temperatures for outgassing purposes are generally permissible.

This faceplate mounting arrangement has been used for a comparatively small size cathode ray tube having a generally rectangular rear housing defining a rectangular opening with a peripheral, inwardly-projecting, flange to the outer surface of which a rectangular glass faceplate is sealed using glass frit. In such a tube, the size of the seal area becomes more important and so a glass frit seal is advantageous. However, problems have been experienced in that cracks can occasionally appear in the glass of the faceplate at its edges during evacuation of the envelope, or during the subsequent baking of the tube for outgassing purposes as a result of mechanical stresses introduced during evacuation, in the manufacturing process. These cracks have been found to occur more often at corners of the faceplate.

It is one object of the present invention to provide a simple, reliable and effective arrangement for sealingly bonding a flat glass faceplate to a metal rear housing of a cathode ray tube.

It is another object of the present invention to provide a cathode ray tube having a faceplate mounting arrangement capable of withstanding stresses likely to cause damage thereto deriving from manufacturing procedures, such as evacuation and baking, and enabling a glass frit seal to be employed for bonding in a vacuum-tight manner the faceplate to the flange on the rear housing.

SUMMARY OF THE INVENTION

According to the present invention, a cathode ray tube having an envelope comprising a metal rear housing having a wall portion defining an opening and a substantially flat glass faceplate which extends over the opening and is sealed in a vacuum-tight manner to the surface of a flange on the rear housing extending around the opening, is characterised in that the flange extends from the wall portion in one direction and turns back on itself in substantially the opposite direction to provide an outer surface remote from the wall portion, and in that the faceplate is bonded to that outer surface of the flange.

It has been found that cathode ray tubes manufactured with a faceplate mounting arrangement employing the aforementioned shape of flange do not suffer from the problem of cracks occuring in the glass faceplate at its edges during the evacuation or subsequent baking operations.

Consideration of the mechanical aspect of the envelope construction suggests that the occurrence of cracks at the edges of the glass faceplate in the earlier arrangement might result from stresses at the outermost region of the glass-seal-metal bond caused by, on the one hand, rotation of the faceplate with respect to the flange upon small inward deflections of the faceplate likely during evacuation, and the seal tending to maintain the peripheral edge of the faceplate in a flat plane on the other. These stresses may produce glass cracking during this process or may lead to cracks being produced when the glass faceplate bonded to the rear housing is subsequently heated during the baking process. Whilst the flange in the earlier arrangement exhibits some flexibility to accommodate possible slight deflections of the faceplate, this flexibility, apparently, is not always sufficient, particularly when a comparatively stiff seal such as a glass frit seal is employed. A compliant seal such as a compliant pressure bonded seal can tolerate a certain amount of flexing and thus allow limited movement of the faceplate edge with respect to the flange, but this could in certain circumstances be exceeded.

The mechanical stresses produced are likely to be more pronounced at the faceplate corner regions than elsewhere as the flange, by virtue of its shape at these regions, will be stiffer.

Under these conditions, it is necessary in order to maintain equilibrium of the faceplate that fairly large holding down forces be generated, particularly at the corners. Apparently with the geometry of this earlier arrangement these forces can exceed the strength of the glass-seal-metal bond leading to cracks.

The mounting arrangement according to the invention, which can be realised in practice by the flange having for example a "V" or "U"-shape cross-section, results in a greater flexibility of that part of the flange bonded to the outermost edge portion of the faceplate enabling that outermost edge to move slightly relative to the rear housing wall portion. Thus, it is no longer constrained to a flat plane. In effect, the flange has two hinges, one where it joins the wall portion of the rear housing and another at the point where the flange is turned back on itself. These two hinges provide a high degree of flexibility for the free end of the flange onto which the faceplate's peripheral edge is secured and which is able then to conform with the deflected faceplate. Hence, excessive stressing of the outer edge of the faceplate resulting from deflection of the faceplate upon evacuation of the envelope is avoided.

In addition, the flexibility afforded by the flange can enable thinner glass faceplates to be used than previously, thereby reducing the overall weight of the tube, even though greater deformation may be experienced with a thinner faceplate after evacuation.

Although the invention is particularly advantageous when glass frit sealing is used, it is envisaged that it can also be used to advantage with compliant pressure bonded seals to supplement the limited flexibility afforded by such a seal and enhance the envelope's ability to accommodate faceplate deflections without excess stressing.

Preferably, the outer surface of the flange remote from the wall portion and onto which the faceplate is secured is substantially flat. This outer surface could be slightly curved, the thickness of, for example, the glass frit material varying across the width of the flange to compensate, but with a substantially flat outer surface the amount of glass frit material is minimised.

In one embodiment of the invention, the portion of the flange which extends in said one direction, the first portion, extends outwardly of the opening and the portion extending in the opposite direction, the second portion, extends inwardly of the opening. In this embodiment, the flange may have a U-shape cross-section with the two portions, which are preferably both substantially flat, being parallel, or, alternatively, may have a V-shape cross-section with the two portions being mutually inclined. In both cases, the surface of the second portion remote from the rear housing wall portion, onto which the faceplate is secured, and extending around the periphery of the opening, should lie in a substantially flat plane, and a major part of the second portion preferably is spaced from the first portion to allow relative displacement as well as displacement of both portions with respect to the rear housing wall. The aforementioned surface of the first portion need not lie exactly in a flat plane as a certain amount of deviation of the surface from the ideal, flat, plane at points around its length can be tolerated by compression of the flange, acting in the manner of bellows, upon seating of the faceplate thereon.

When the faceplate deflects slightly following evacuation of the envelope, the second portion of the flange is able to follow any displacement of the edge of the faceplate by movement of the second portion and/or the first portion relative to the rear housing wall portion by virtue of the joins between the first and second portions and between the first portion and the wall portion acting as hinges.

In a second, and preferred, embodiment, the first and second portions of the flange extend respectively inwardly and outwardly of the opening. This has the advantage that the exterior dimensions and the interior volume of the envelope are both minimised. Also, in this arrangement the outermost edge of the faceplate is supported by the free end of the second portion of the flange and is thus less restrained and capable of greater movement than is the case with the first embodiment where the free end of the second portion of the flange is inwards of the outermost edge of the faceplate. Again, the flange can be, for example, either V-shape or U-shape in cross-section. With this arrangement, inward deflection of the faceplate tends to lift the outer edge of the faceplate in a direction away from the wall portion and is accommodated by the first and second portions moving apart. As such it is not essential for a gap to be provided between at least a major part of the width of the second portion and the first portion but this is still desirable if it is required that the flange be able also to accommodate situations where the outer surface of the second portion does not completely lie in a flat plane by compression of the flange as previously described.

In both embodiments, the flange may extend continuously completely around the opening thereby avoiding difficulties with achieving reliable vacuum-tight sealing at one or more joints otherwise necessary around the length of the flange.

The flange may be formed integrally with the wall portion of the rear housing, for example, by pressing and bending techniques. However, in the case of a rectangular opening and a continous flange special care will need to be taken at corner regions using this technique. Preferably, therefore, only the first portion of the flange is formed integrally with the wall portion , this first portion being bent inwardly by pressing, and the second portion is formed as a separate element, for example as a flat continuous rectangular strip by stamping, and is joined to the innermost edge of the first portion, by, for example, laser beam welding or brazing. This form of assembly facilitates construction of the envelope where corners are involved. Alternatively, the first and second portions of the flange could comprise a single piece, formed by stamping and bent into the required shape, joined to the edge of the wall portion of the rear housing by, welding or brazing.

BRIEF DESCRIPTION OF THE DRAWINGS

Examples of cathode ray tubes in accordance with the invention will now be described, by way of example, with reference to the accompanying drawings, in which.

DESCRIPTION OF THE PREFERRED EMBODIMENTS

Figure 1:
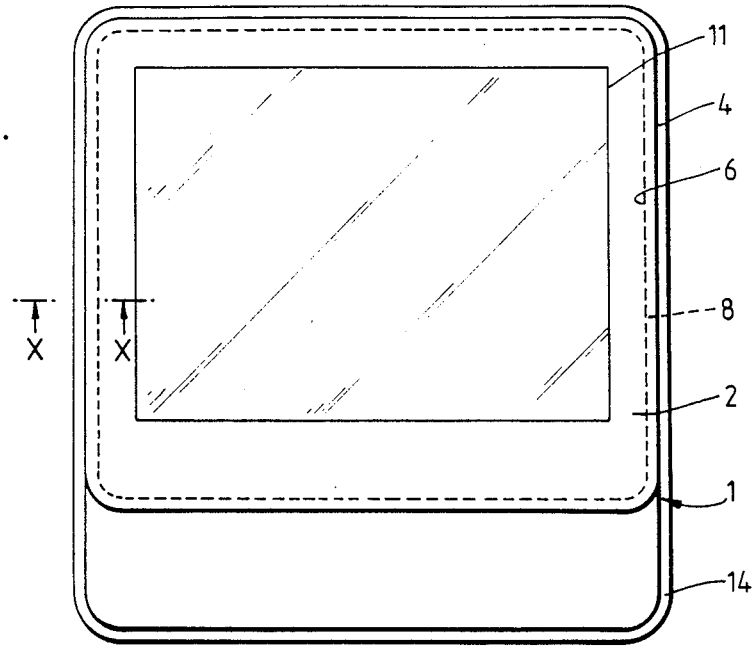
FIGS. 1 and 2 are plan and side elevational views respectively of an example of a cathode ray display tube in accordance with the invention having a flat glass faceplate and a generally rectangular, and flat, metal rear housing.
Figure 2:
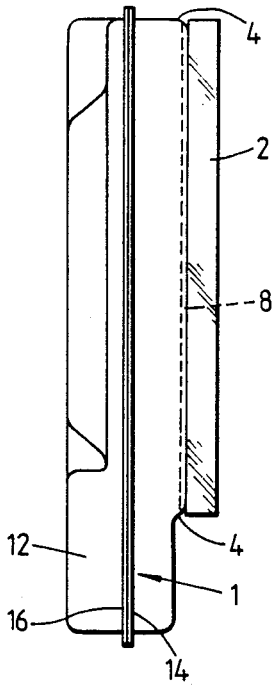

The cathode ray display tube has an envelope comprising a rectangular flat-can metal alloy rear housing 1 and a substantially flat, rectangular, faceplate 2 of plate glass having dimensions of around 190 mm by 170 mm. The metal alloy of the rear housing and the faceplate have thicknesses of around 1 mm and 10 mm respectively. The metal alloy is chosen to be thermally matched with the glass of the faceplate and comprises a nickel steel alloy. The rear housing 1 is formed for example by deep drawing from metal alloy sheet and has a rectangular, straight-edged, side wall portion 4 which meets the faceplate 2 at approximately ninety degrees with respect to the plane of the faceplate and defines a rectangular opening 6 over which the faceplate lies. Only a small part of the side wall portion 4 of the rear housing, the faceplate 2 and the opening 6 are visible in FIGS. 3 and 4. The bottom of the rear housing is largely flat but has strengthening ribs and depressions formed therein for locating internal components of the tube.

The rear housing 1 is formed in two parts, an upper part comprising the generally rectangular side wall portion 4 and flange 8 and a lower part 12 comprising a lower side wall portion mated with the side wall portions 4 and the generally flat base. With this arrangement, the upper part of the rear housing is firstly bonded to, and sealed with, the faceplate. Thereafter the internal components are installed and the lower part 12 of the rear housing joined to the upper part 4 around respective peripheral mating lip edges 14 and 16 by laser welding so as to form a vacuum-tight, and rigid, joint.

A phosphor screen, carried on the internal surface of the faceplate 2, is indicated at 11 in FIG. 1.

For simplicity, the internal components of the tube are not shown and a description thereof is not considered necessary here. However, these components and their operation are described in British patent specification No. 2,101,396 A, details of which are incorporated herein by reference and to which attention is directed for further information in this respect.

Figure 3:
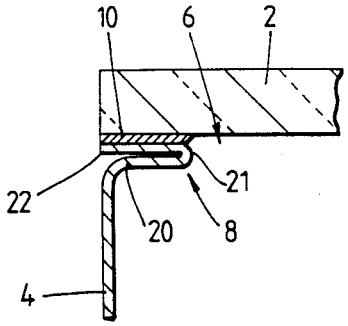
FIG. 3 is a fragmentary cross-sectional view through a part of the tube, along the the line X—X of FIG. 1 and drawn to an enlarged scale, illustrating an embodiment of faceplate mounting arrangements in accordance with the invention.

Referring to FIG. 3, there is shown the arrangement by which the flat faceplate 2 is mounted on the wall portion 4 of the rear housing 1. The rear housing is provided with a continuous, substantially flat-surfaced, flange 8 running completely around the opening 6 and which extends in a first direction and is turned back on itself to extend in the opposite direction. The flange 8 is provided at the uppermost end of the side wall portion 4 and has a width, i.e. a dimension inwardly of the opening, of approximately 5mm. As shown in FIG. 3, the flange 8 has a U-shape cross-section and comprises a first, flat-sided portion 20 which extends inwardly of the opening 6 substantially at right angles to the side wall portion 4 and a second, flat-sided portion 22, joined to the first portion by a bend 21, extending outwardly of the opening 6 substantially parallel to, coextensive with, and slightly spaced apart from the first portion 20. The spacing of the first and second portions 20 and 22 may be around 0.5 mm. The uppermost surface, as shown in FIG. 3, of the portion 22, i.e. the surface of the flange 8 remote from the wall portion 4, defines a continuous flat surface extending around the periphery of the faceplate 2 and lying substantially in a flat plane at approximately 90 degrees to the side wall portion 4 onto which the faceplate 2 is secured. The faceplate 2 is bonded to this surface by means of a suitable glass frit seal 10 using conventional techniques. Glass frit seals and methods of their application and processing for bonding glass to metal are well known in the art. In this particular embodiment, a vitreous glass frit containing powdered aluminium oxide and having the desired coefficient of thermal expansion is used which is screen printed on the faceplate. The seal 10 extends completely around the length of the flange 8 and over substantially the entire width of the upper surface of portion 22.

Figure 4:
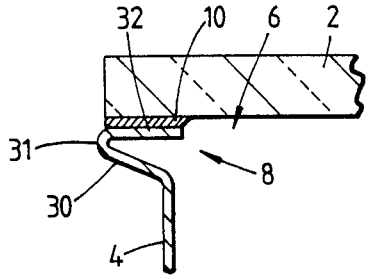
FIG. 4 is a similar fragmentary view of another embodiment of the invention illustrating an alternative form of faceplate mounting arrangement.

With regard to the embodiment of FIG. 4, the rear housing is again provided at the uppermost end of the side wall portion 4 with a continuous, flat-surfaced, flange 8 completely around the opening 6 and which extends in a first direction and then turns back on itself in substantially the opposite direction. More precisely, and as can be seen in FIG. 4, the flange 8 has a generally V-shape cross-section and comprises a first, flat-sided portion 30 projecting outwardly of the opening 6 at an oblique angle to the side wall portion 4 which is joined by a bend 31 to a second, flat-sided portion 32, approximately 5 mm in width, that extends inwardly of the opening 6 at an acute angle with respect to portion 30 and with the plane of its uppermost surface as shown in FIG. 4, i.e. its surface remote from portion 4, being substantially flat and lying approximately at 90 degrees to the side wall portion 4. The diverging portions 30 and 32 are coextensive, with the free end of the portion 32 terminating approximately at the line of the side wall portion 4, although portion 32 could extend further inwards if desired to increase the faceplate bond area.

The glass faceplate 2 is bonded to the upper surface of the second portion 32 of the flange 8 in a vacuum-tight manner by means of a suitable glass frit seal 10, such as that previously described.

Referring to the embodiments of both FIGS. 3 and 4, the flange 8 may be formed integrally with the side wall portion 4. Preferably, however, only the first portion, 20 and 30 respectively, of the flange 8 is formed integrally with the side wall portion 4 by providing an extension on the side wall portion and bending this extension in the appropriate direction during manufacture of the side wall portion 4 to define the first portion. The second portion, 22 and 32 respectively, of the flange 8 is formed as a separate flat strip element from the same material as the side wall portion 4 and is joined at its one edge to the first portion, by laser beam welding or brazing, the weld or brazing constituting the bend 21 or 31 respectively.

In another method, the entire flange 8 is formed as a separate element, again from the same material as side wall portion 4, from a flat strip which is bent into the required U or V-shape and joined to the upper end of the side wall portion 4 by welding or brazing.

In both the above methods using separate elements to form all or part of the flange, it is envisaged that the material of these separate elements could be different from that of the side wall portion 4.

It will be appreciated that by virtue of the first and second portions, 20 and 22, and 30 and 32, of the flange 8 in the two embodiments, the flange 8 can accommodate minor variations in the flatness of the plane of the upper surface of the second portion, 22 and 32, or the mating surface of the faceplate 2 by compression, the flange acting in this respect like bellows. Thus, if for example, the upper surface of the second portion of the flange does not lie in a completely flat plane, the flange 8 can deform in parts along its length where necessary upon the faceplate 2 being sealed thereon with pressure to match the flatness of the surface of the faceplate 2. Minor variations in the thickness of the applied front seal material can also be accommodated in this manner.

Upon evacuation of the envelope, via a suitable, sealable, pump stem (not shown) attached to the rear housing, the faceplate 2 is deformed inwardly of the envelope slightly under the influence of ambient atmospheric pressure. This deformation can result in the centre of the faceplate being deflected downwardly into the envelope by up to around 0.5 mm. The flange 8, however, is able to accommodate this deflection readily. The second portion, 22 and 32 respectively, flexes to conform with the deflection of the edge of the faceplate 2 with the bend region 21 and 31, respectively and the region where the first portion, 20 and 30, is joined to the side wall portion 4 acting as hinges to facilitate flexure. In this way, compression between the flange 8 and the peripheral edge portion of the faceplate 2 is maintained.

Because the outer sealed edge of the second flange portion, 22 and 32 respectively, can flex the form of the outer edge of the faceplate 2 is not constrained to a flat plane, particularly at the corners. The flange's second portion, 22, 32, are able to move slightly upwardly from the side wall portion 4 which is particularly important at the corners where most stress is likely to be encountered. In effect, a small amount of rotation of the peripheral edge portion of the faceplate 2 and the second portion of flange 8 is permissible. This lifting capability reduces or eliminates the holding down forces required at the corners and consequently results in a reduction of the stresses on the glass-frit-metal seal.

Evacuation of the envelope and subsequent inward deflection of the faceplate might also result in slight relative movement between the faceplate 2 and the flange 8 in a direction generally parallel to the planes of their adjacent surfaces. These slight relative movements can also be accommodated by the flexible nature of the flange 8.

Although the particular embodiment of the tube described has a rectangular faceplate and rear housing, the invention is applicable also to tubes having faceplates and rear housings of different shape. For example, the faceplate and at least the side wall portion of the rear housing adjacent the faceplate may be circular. Alternatively, the faceplate may be of more conventional form being generally rectangular but with edges of slightly convex curvature.

I claim:

1. A cathode ray tube having an envelope comprising a metal rear housing having a sidewall portion defining an opening and a substantially flat glass faceplate which extends over the opening and is sealed in a vacuum-tight manner to the surface of a flange on the rear housing extending around the opening, characterized in that the flange comprises a first portion connected to the sidewall portion and extending from the side wall portion in one direction, with the connection between this first portion and the sidewall portion serving as a hinge, and a second portion connected to the first portion and extending in substantially the opposite direction over the first portion, with the connection between the first and second flange portions serving as a further hinge, the second portion providing an outer surface onto which the faceplate is bonded and rotating with respect to the side wall portion by virtue of the flange hinges thereby to conform with deformation of the faceplate upon evacuation of the envelope and further characterized in that the flange is integrally formed as a single element with the sidewall portion.

2. A cathode ray tube according to claim 1, characterised in that the flange has a substantially V-shape cross-section.

3. A cathode ray tube according to claim 1, characterised in that the flange has a substantially U-shape cross-section.

4. A cathode ray tube according to claim 1, characterised in that the portion of the flange extending in said one direction extends from the wall portion outwardly of the opening.

5. A cathode ray tube according to claim 1, characterised in that the portion of the flange extending in said one direction extends from the wall portion inwardly of the opening.

6. A cathode ray tube according to claim 5, characterised in that the portion of the flange extending in said substantially opposite direction is substantially coextensive with the first-mentioned portion of the flange.

7. A cathode ray tube according to claim 1, characterised in that the portions of the flange extending respectively in said one and said substantially opposite directions are spaced apart from one another over a major part of their width.

8. A cathode ray tube according to claim 1, characterised in that said outer surface of the flange remote from the wall portion is substantially flat.

9. A cathode ray tube according to claim 1, characterised in that said outer surface of the flange remote from the wall portion extends continuously completely around the opening.

10. A cathode ray tube according to claim 1, characterised in that the faceplate is bonded to said outer surface of the flange remote from the wall portion by means of a glass frit seal.

* * * * *